US008037790B2

(12) United States Patent
Gauthier

(10) Patent No.: US 8,037,790 B2
(45) **Date of Patent: *Oct. 18, 2011**

(54) INDICATOR FOR TORQUE LIMITING TOOL

(75) Inventor: Michael T. Gauthier, Grafton, WI (US)

(73) Assignee: Gauthier Biomedical, Inc., Grafton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/896,562

(22) Filed: Oct. 1, 2010

(65) Prior Publication Data

US 2011/0036215 A1 Feb. 17, 2011

Related U.S. Application Data

(63) Continuation of application No. 12/192,295, filed on Aug. 15, 2008, now Pat. No. 7,806,026, and a continuation-in-part of application No. 11/750,175, filed on May 17, 2007, now Pat. No. 7,430,945.

(60) Provisional application No. 60/956,549, filed on Aug. 17, 2007.

(51) Int. Cl.
*B25B 23/143* (2006.01)

(52) U.S. Cl. ..... 81/467; 81/478

(58) Field of Classification Search ..... 81/467, 81/477–483

See application file for complete search history.

(56) References Cited

U.S. PATENT DOCUMENTS

| | | | | |
|---|---|---|---|---|
| 1,860,871 | A * | 5/1932 | Pouliot | 81/480 |
| 2,682,796 | A * | 7/1954 | Larson | 81/479 |
| 2,686,446 | A * | 8/1954 | Livermont | 81/482 |
| 4,466,523 | A | 8/1984 | De Carolis et al. | |
| 5,437,212 | A | 8/1995 | Thompson et al. | |
| 5,520,073 | A | 5/1996 | Bakula et al. | |
| 5,535,648 | A | 7/1996 | Braun et al. | |
| 5,551,323 | A | 9/1996 | Beere et al. | |
| 5,613,585 | A | 3/1997 | Tiede | |
| 5,619,891 | A | 4/1997 | Tiede | |
| 5,622,089 | A | 4/1997 | Gifford, Sr. | |
| 5,647,252 | A | 7/1997 | Miner | |
| 5,749,272 | A | 5/1998 | Phan | |
| 5,771,760 | A | 6/1998 | Tiede | |
| 5,778,743 | A | 7/1998 | Tiede | |
| 5,848,680 | A | 12/1998 | Rinner | |
| 5,910,196 | A | 6/1999 | Huang | |
| 5,928,154 | A | 7/1999 | Silber et al. | |
| 5,943,755 | A | 8/1999 | Gauthier et al. | |
| 2007/0039425 | A1 * | 2/2007 | Wang | 81/467 |

* cited by examiner

*Primary Examiner* — David B Thomas
(74) *Attorney, Agent, or Firm* — Boyle Fredrickson S.C.

(57) ABSTRACT

A torque wrench is provided that includes a handle in which is disposed a torque limiting mechanism and a torque indicator engaged with the torque limiting mechanism. The torque limiting mechanism functions to limit the maximum torque that can be transmitted by an individual through the tool, while the indicator provides a visible indication to the individual when a specified amount of torque is being provided through the tool that is less than the amount which causes the torque limiting mechanism to operate.

7 Claims, 5 Drawing Sheets

127
138
129
104
120
122
112
102
148
200
210
224
151
214
222
254
121
158
148
140
140
202
212
208
254
134
151
158
232
255
300
236
238
304
302
206
226
227
227a
216
218
220
234
204
155
152
138
134
136
150
154
155
150
132
136
154
255
256
500

INDICATOR FOR TORQUE LIMITING TOOL

CROSS-REFERENCE TO RELATED APPLICTIONS

This application is a continuation of U.S. Non-Provisional application Ser. No. 12/192,295, filed on Aug. 15, 2008, now U.S. Pat. No. 7,806,026 which claims priority from both U.S. Provisional Patent Application Ser. No. 60/956,549, filed on Aug. 17, 2007, and as a continuation-in-part application from U.S. Non-Provisional application Ser. No. 11/750,175, filed on May 17, 2007, now U.S. Pat. No. 7,430,945, each of which is expressly incorporated herein by reference in its entirety.

FIELD OF THE INVENTION

The present invention relates to tool, such as torque wrenches, and, more specifically, to a tool including a torque level indicator on the wrench.

BACKGROUND OF THE INVENTION

In order to drive a screw or other fastener into a substrate, various driving tools, such as torque wrenches are utilized. Torque wrenches are utilized primarily because of their ability to closely control the amount of torque that can be applied to the fastener. Thus, the fastener can be driven into the substrate with the desired level of torque, thereby preventing damage from being done to the substrate as a result of overdriving the fastener into the substrate.

While this ability is important in many areas, it is especially important in the medical field, where fasteners are often utilized to hold parts of a patient's anatomy together. Therefore, to prevent damage from being done to the patient by the fastener, it is necessary to insert the fasteners into the patient with a precise amount of force to engage the fasteners with the patient without damaging the body portions of the patient to which the fasteners are affixed.

To accomplish this, a number of different torque limiting mechanisms have been developed for use with fastener-driving tools, such as torque wrenches, which allow the fastener-engaging portion of the wrench to slip with regard to the driving portion of the wrench when a preset maximum torque value has been exceeded. In this manner, the torque limiting mechanism enables the individual utilizing the tool to use the necessary force to engage the fastener with the substrate, but mechanically disengages the tool from the fastener when the individual applies too much torque to the fastener via the tool.

When using fastener-driving tools including torque limiting mechanisms of this type, many of these mechanisms do not provide any indication of the actual torque level at which the wrench or other tool is being utilized prior to the torque limiting mechanism being actuated. In other words, other than the initial setting for the limit at which the torque limiting mechanism is set to disengage the driving portion of the tool from the fastener engaging portion, there is no indication of this level or how close the tool is being operated to this level provided to the individual using the tool. As a result, oftentimes the individual utilizing the wrench exerts more torque through the tool to the fastener than is required, which causes the torque limiting mechanism to activate, when it was not necessary for the tool to be operated at that torque level.

Therefore, it is desirable to develop a tool including a torque limiting mechanism that also provides an indication of the amount of torque being applied by the tool prior to the actuation of the torque limiting mechanism, such that the proper or desired amount of torque below the limit at which the mechanism will operate can be applied to an item utilizing the tool.

SUMMARY OF THE INVENTION

According to one aspect of the present invention, a driving tool includes a drive shaft capable of engaging a fastener for driving the fastener into a substrate. The drive shaft is connected to a torque limiting mechanism that operates to prevent the torque applied to the fastener and substrate via the drive shaft from exceeding a predetermined maximum level. This level is preset by the manufacturer of the tool, or in certain constructions for the mechanism, can be adjusted to the desired level by the end user of the tool.

In one embodiment of the torque limiting mechanism, the drive shaft is formed with a number of engagement surfaces spaced around the periphery of the portion of the drive shaft that is inserted within a handle for the tool. This portion of the drive shaft is inserted within a handle for the tool such that the drive shaft is rotatable with respect to the handle. On one or both sides of the portion of the drive shaft within the handle are disposed engagement members that are selectively engageable with the engagement surfaces on the drive shaft. The engagement members are urged into engagement with the engagement surfaces on the drive shaft by biasing members extending between the engagement members and the closed ends of the handle. The bias of the springs urges the engagement members into engagement with the engagement surfaces to couple the handle to the drive shaft and enable the drive shaft to rotate in conjunction with the handle and drive the fastener into the substrate.

However, should the torque transmitted through the handle and engagement members to the drive shaft exceed the biasing force of the biasing members, the torque exerted on the handle causes the handle to rotate with respect to the drive shaft. As a result, the engagement surfaces become misaligned with he engagement members, and the drive shaft pushes the engagement members away from the engagement surfaces against the bias of the biasing members. This, in turn, causes the engagement members to slide with respect to the engagement surfaces, allowing the handle to rotate around an independently of the drive shaft. This mechanism greatly reduces the friction and resulting wear in the mechanism, lengthening the useful life of the tool.

The torque limiting mechanism additionally includes an indicator operably connected to one of the plungers in the mechanism. The indicator provides a visible indication that a preset torque value has been reached by the operation of the tool by an individual to alert the individual of the amount of torque currently being applied through the tool by the individual. In one embodiment, the indicator includes a pin or button engaged by a spring that operates to urge the button outwardly from the handle through an opening in the handle adjacent the button. The button is held within the handle through the engagement of the button with a locking mechanism also disposed within the handle. The locking mechanism holds the button inside the handle until, through the use of the tool at a torque level approaching, but below the limit specified for the activation of the torque limiting mechanism, the plunger is urged slightly away from the drive shaft. When the plunger moves away, it contacts the button and moves the button against the bias of the locking mechanism, thereby disengaging the locking mechanism and enabling the spring to urge the button outwardly from the handle to indicate a specified torque level for the operation of the tool.

Numerous other aspects, features, and advantages of the present invention will be made apparent from the following detailed description together with the drawings figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
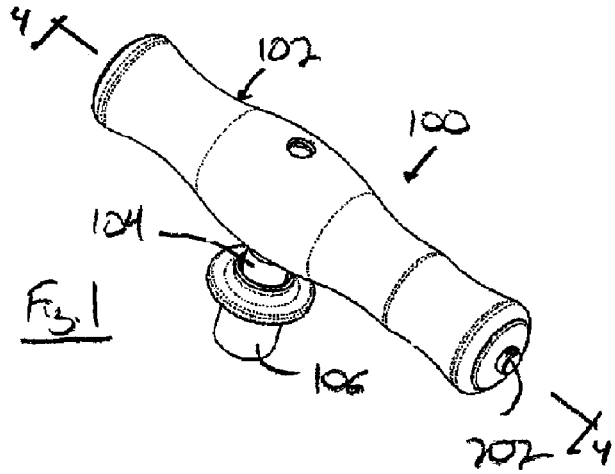
FIG. 1 is an isometric view of a torque wrench including the torque limiting mechanism and torque indicator constructed according to the present invention.

With reference now to the drawing figures in which like reference numerals designate like parts throughout the disclosure, a driving tool, e.g., a torque wrench, constructed according to the present invention is indicated generally at 100 in FIGS. 1-4. The wrench 100 includes a handle 102 from which extends a shaft 104 having a drive shaft release member 106 attached thereto opposite the handle 102. Release member 106 is utilized to secure an implement (not shown) thereto that can engage and drive a fastener (not shown) into a substrate. The tool 100 can also include a suitable ratcheting mechanism 500 engaged with the shaft 104 and disposed on the handle 102, as best shown in FIG. 5.

Figure 4:
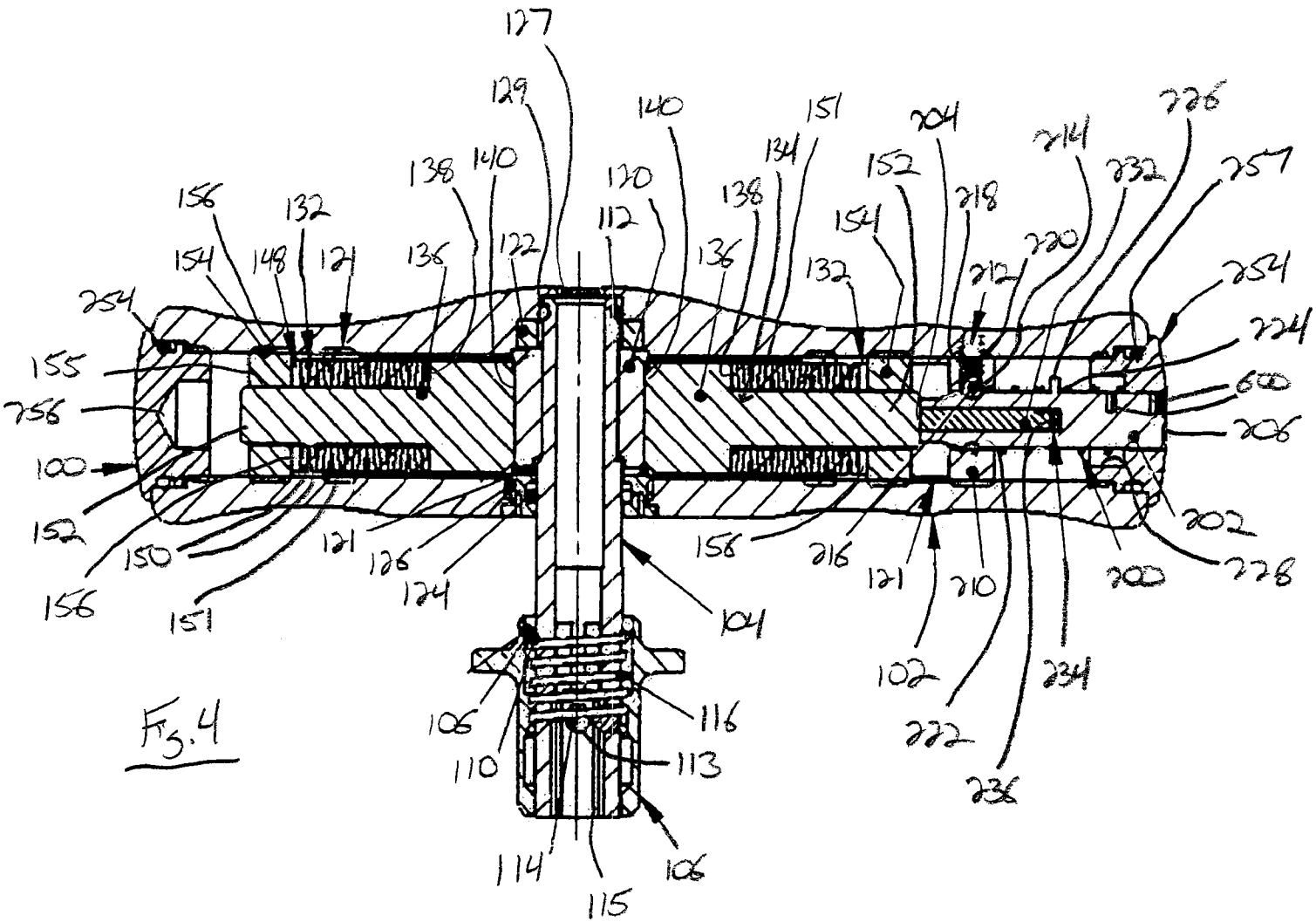
FIG. 4 is a cross-sectional view along line 4-4 of FIG. 1.
Figure 5:
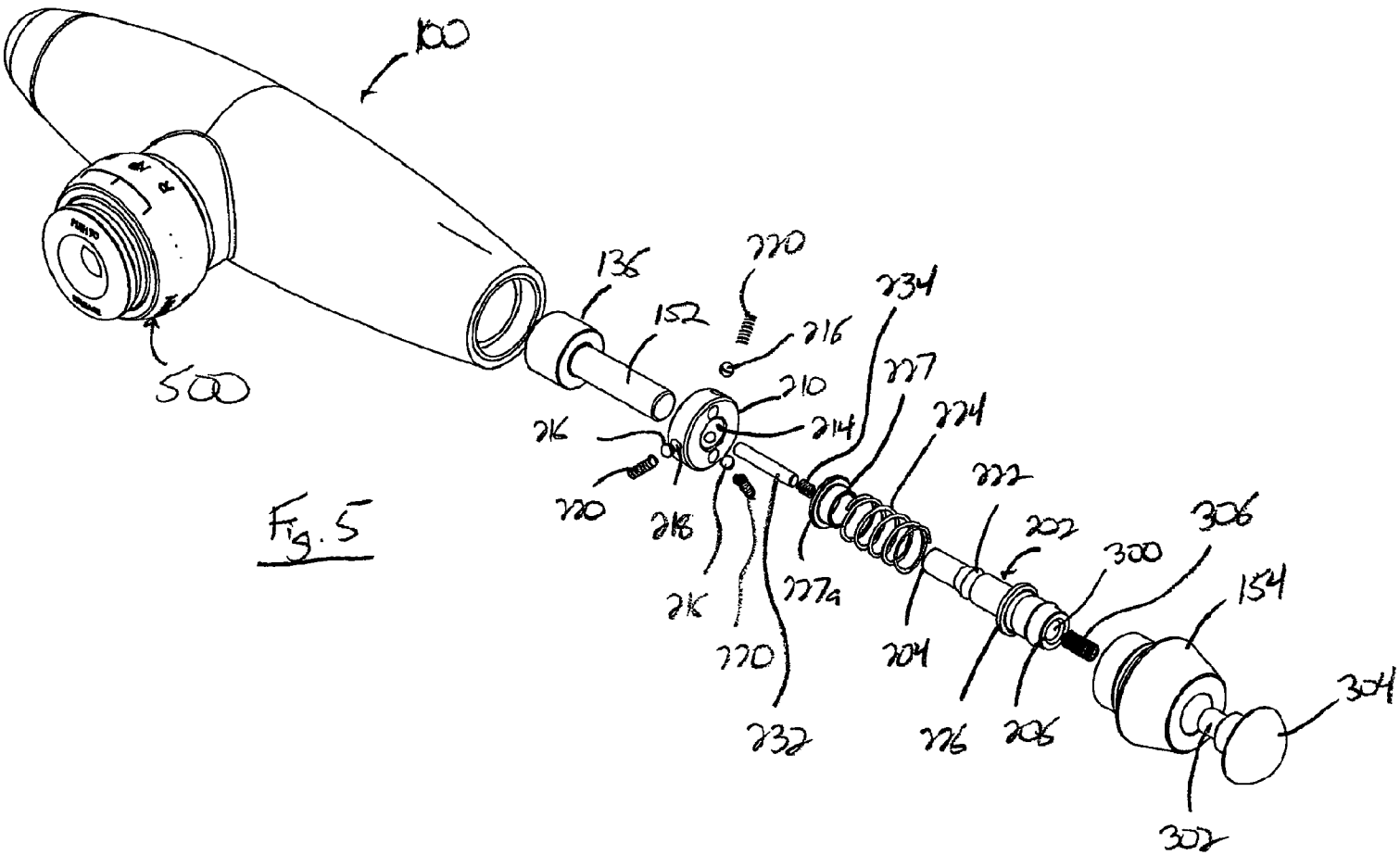
FIG. 5 is an exploded, isometric view of a tool including a second embodiment of the torque indicator of FIG. 1.

Looking now at FIG. 4, the drive shaft 104 includes an outer section 110 integrally connected to an inner section 112 that is positioned within the handle 102. The outer section 110 is generally cylindrical in shape and includes a number of circular openings 114 spaced equidistant around the outer section 110. The openings 114 are adapted to receive ball bearings 113 therein that are used to engage and retain the implement that is inserted into a central channel 115 defined within the outer section 110. The ball bearings 113 can be moved into and out of the openings 114 and the channel 115 by the movement of the release member 106 in opposition to a spring 116 secured between the outer section 110 of the shaft 104 and the release member 106. When the release member 106 is moved along the shaft 104 against the bias of the spring 116, the ball bearings 113 can move into the openings 114 and out of the channel 115, thereby exposing the interior of the channel 115 to enable the implement to be inserted therein. Once a notch (not shown) on the implement is aligned with the openings 114, the release member 106 can be released such that the spring 116 moves the release member 106 over the openings 114 into the channel 115 to urge the ball bearings 113 through the openings 114 and partially into the notch, thereby holding the implement in connection with the shaft 104.

The inner section 112 of the shaft 104 includes an expanded section 120 that is disposed within a longitudinal channel 121 extending completely through the handle 102, with the rotational axis of the shaft 104 in perpendicular alignment with the longitudinal axis of the channel 121. Alternatively, the inner section 112 can be formed without the expanded section 120, or with the expanded section 120 formed separately from but fixed to the inner section 112. The inner section 112 and expanded section 120 are rotatably mounted within the handle 102 using any suitable structure, such as by a roller bearing 122 secured within the handle 102 and against which the expanded section 120 is engaged. Opposite the roller bearing 122, the expanded section 120 is held within the handle 102 by a sealing member 124, such as an O-ring, to prevent fluid or other material from entering the handle 102, and a cover cap 126 that each defines a central opening 128 therein through which the shaft 104 can extend outwardly from the handle 102. Opposite the cap 126, the handle 102 can also include a top cap 127 and a sealing member 129 to enclose and seal off the opposite side of the handle 102. Alternatively, the tool 100 can include a second roller bearing 122 positioned between the O-ring 124 and the expanded section 120 to hold the inner section 112 and expanded section 120 within the handle 102.

The expanded section 120 of the shaft 104 has an outer diameter greater than the diameter of both the outer section 110 and the remainder of the inner section 112, and includes a number of engagement surfaces 128 spaced therearound. The engagement surfaces 128 are preferably spaced equidistant from one another around the entire periphery of the expanded section 120, and can be formed to have any suitable shape. Alternatively, in those embodiments where the expanded section 120 is omitted, the engagement surfaces 128 can be formed directly in the inner section 112 and/or can be formed as flat surfaces on the inner portion 112 or expanded portion 120, or can be formed as depressions, grooves, projections or other suitable engagement surfaces 128.

In order to provide the torque limiting function with regard to the rotation of the inner section 112 and/or expanded section 120 of the shaft 104 with regard to the handle 102, a torque limiting mechanism 132 is disposed within the longitudinal channel 121 inside the handle 102 and engaged with the expanded section 120. The mechanism 132 is entirely disposed within the handle 102 and includes a pair of engagement members or plungers 134 disposed adjacent opposite sides of the expanded section 120 of the shaft 104. Each plunger 134 includes a body 136 dimensioned to fit within the channel 121, preferably with a cross-section similar to that of the channel 121, such as circular, and defining a flat rear surface 138 and a flat front surface 140. Alternatively, the front surface can be formed with other suitable engaging surfaces (not shown) such as various types of projections or depressions to assist the members 134 in correctly engaging the surfaces 128 on the shaft 104.

The front surface 140 of each plunger 134 is biased into engagement with the engagement surfaces 128 on the expanded section 120 by a pair of compression members 148 that engage the rear surfaces 138 of each plunger 134. The compression members 148 can be formed as desired, but are each preferably formed from as a number of circular compression springs 150 that are positioned at least partially within guide tubes 151 located within the channel 121 adjacent the expanded section 120, and are disposed around a projection 152 extending outwardly from the rear surface 138 of the body 136. The compression springs 150 abut the flat rear surface 138 of the member 134 and one another along the length of the projection 152, and are held in position on the projection 152 by a stop member 154 that is engaged with the handle 102 within the longitudinal channel 121. The stop member 154 is held within the channel 121 using any suitable means, such as an adhesive or other mechanical securing or fastening means, but preferably is held therein by forming the stop member 154 with a cross-section slightly larger than the diameter of the channel 121 and disposing the stop member 154 within a groove formed in the channel 121 at the desired position for the stop member 154. Further, it is also contemplated that the position of the stop member 154 within the channel 121 can be adjustable using any suitable means. The primary reason for this is that position of the stop member 154 within the channel 121 controls the compression exerted on the springs 50 by the stop member 154, and thus the amount of force required to move the plunger 134 away from the shaft 104 against the bias of the springs 150. Thus, by allowing the stop member 154 to be moveable within the channel 121, the amount of force exerted on the springs 150 can be adjusted as desired. The position of the nuts 154 can be determined or measured as necessary in any suitable manner during assembly of the tool 100 or during use of the tool 100 to ensure that the maximum torque value for the mechanism 132 is set as desired.

The stop member 154 includes a central opening 155 through which the projection 152 slidably extends to allow the plungers 134 to move within the channel 121 and to maintain the alignment of the plunger 134 within the channel 121. Additionally, a washer 156 can be placed on the interior side of the stop member 154 to provide a rigid base against which the compression springs 150 can press without damaging or potentially dislodging the stop member 154.

The handle 102 also includes a pair of end caps 254 engaged with the handle 102 at opposite ends of the channel 121. Each end cap 254 has a sealing member 255 thereon that sealingly engages the end cap 254 with the handle 102 to prevent any fluid or other material from entering the channel 121. One end cap 254 is formed with a blind bore 256 therein that allows the projection 152 on the engagement member 134 to enter the bore 256, if necessary, and prevent any stoppage of the normal operation of the mechanism 132. The opposite cap 254 includes a through bore or aperture 208 for a purpose to be described.

Further, each of the end caps 254 can include thereon an adjustment nut 257 that can be used to expand or contract the size of the end cap 254 as one way in which to move the stop member 154 within the channel 121 to vary the amount of compression provided by the springs 150 against the plungers 134.

In operation, the amount of force provided by the springs 150 urging the plungers 134 into engagement with the surfaces 128 can be varied to set a maximum torque limit for the activation of the mechanism 132. When this maximum torque value has been reached as a result of a twisting force applied to the handle 102 by the individual using the tool 100, the force turning the handle 102 and plungers 134 with regard to the shaft 104 will overcome the bias of the springs 150, such that further rotation of the handle 102 will urge the plungers 134 towards the end caps 154, such that the plungers 134 are consequently disengaged from the adjacent engagement surface 128, as best shown in FIG. 4. This, in turn, mechanically disengages the handle 102 from the shaft 104, such that the handle 102 can rotate independently of the shaft 104 until the force exerted on the handle 102 drops below the bias of the springs, allowing the members 134 to re-engage the surfaces 128.

Figure 2:
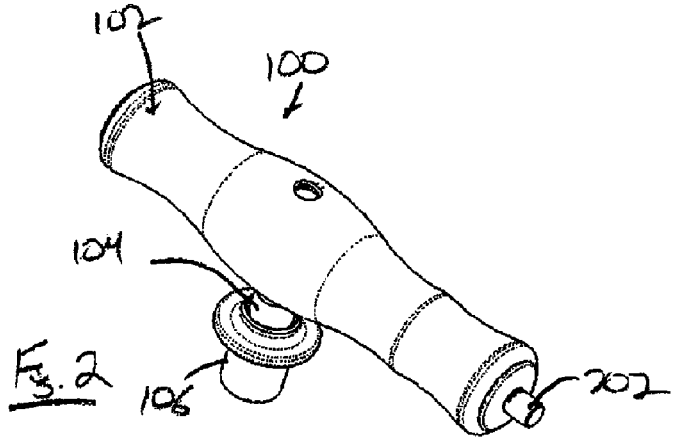
FIG. 2 is an isometric view of the wrench of FIG. 1 with the indicator in an indicating position.
Figure 3:
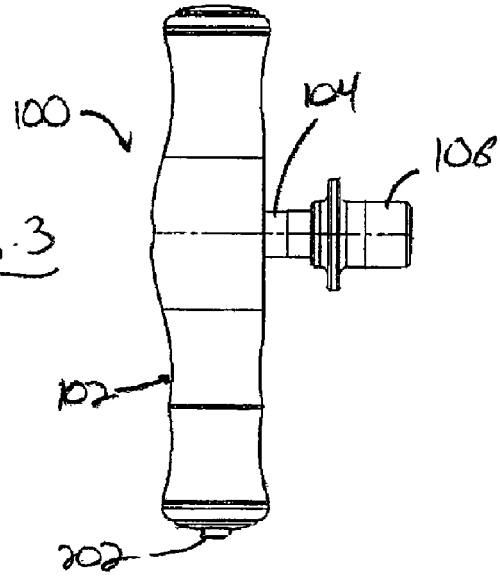
FIG. 3 is a front plan view of the wrench of FIG. 1.

As best shown in FIGS. 1-3, in one optional embodiment for the tool 100, the drive shaft 104 is offset from the center of the handle 102. Thus, the drive shaft 104 and implement secured thereto are positioned closer to the handle 102, allowing the tool 100 to be utilized in locations where the tool's previous embodiment would be unworkable due to the length of the handle 102 extending from opposite sides of the drive shaft 104.

In addition, referring now to FIG. 4, the tool 100 also includes an indicator mechanism 200 operably connected to the torque limiting mechanism 132. In one embodiment, the indicator mechanism 200 includes an indicator shaft 202 disposed within the channel 121 of the handle 102 between one plunger 134 and the adjacent end cap 154. In the embodiment where the drive shaft 104 is mounted in an offset position within the handle 102, the shaft 202 is preferably disposed within the longer side of the channel 121. The shaft 202 includes an inner end 204 engaged with the flat rear surface of the adjacent plunger 134, and an outer end 206.

Between the inner end 204 and the outer end 206, the shaft 202 extends through a support 210 in which is disposed a locking mechanism 212. The support 210 is formed with a central opening 214 through which the shaft 202 can extend. The locking mechanism 212 can be formed with any suitable construction, but preferably includes a bearing 216 disposed within a radial bore 218 formed in the support 210 that is biased towards the central opening 214 by a spring 220 located and held within the bore 218 between the bearing 216 and the interior surface of the channel 121. When biased towards the opening 214, the bearing 216 is seated within a peripheral groove 222 formed on the exterior of the shaft 202 between the inner end 204 and the outer end 206. Additionally, in order to vary the amount of resistive force exerted on the movement of the shaft 202, the support 210 can have multiple bearings 216, bores 218 and springs 220 disposed therein, as best shown in FIG. 5.

The mechanism 200 also includes a biasing member 224 disposed around the exterior of the shaft 202 and extending between the support 210 and an outwardly extending radial flange 226 formed on the exterior of the shaft 202. In a particularly preferred embodiment shown in FIGS. 5-7, a sleeve 227 is positioned against the support 210 adjacent the shaft 202. The sleeve 227 has an interior diameter great than that of the shaft 202 and the opening 214 in the support 202, such that the shaft 202 can pass freely through the sleeve 227. However, the sleeve 227 has a diameter less than that of the biasing member 224, such that the biasing member 224 is disposed around the sleeve 227 and abuts a flange **227*a* the extends radially outwardly fro the end of the sleeve 227 positioned against the support 210. Thus, the sleeve 227 provides an engagement point and a guide for the biasing member 224, which preferably is a spring, to prevent the biasing member 224 from becoming misaligned with respect to the components of the mechanism 200**.

The biasing member 224 is biased to urge the shaft 202 away from the support 210 and outwardly from the handle 102 when the locking mechanism 212 is disengaged from the button 202. The flange 226 serves an additional purpose in that the diameter of the flange 226 is greater than the diameter of an aperture 208 formed in the adjacent end cap 254, such that the flange 226 limits the extent to which the shaft 202 can be urged out of the handle 102 through the aperture 208. In addition, a recess 228 can be formed on the interior surface 230 of the end cap 254 to function both as the stop for the flange 226 and as an aligning member for the shaft 202.

In the alternative embodiment illustrated in FIG. 5, the shaft 202 has a bore 300 disposed within the outer end 206 that receives and engages a receiving shaft 302 of an indicator cap 304. The shaft 302 extends outwardly from the cap 304 and through the aperture 208 in the end cap into engagement with the bore 300. Thus, when the shaft 202 is moved to indicate the torque level of the tool, the movement of the shaft 202 causes the indicator cap 304 to move away from the end cap 254 to provide the visual indication of the torque level that the tool 100 is being operated at.

At the inner end 204, the shaft 202 includes an engagement member 232 disposed within an axial bore 234 formed in the shaft 202. The member 232 is biased outwardly from the bore 234 by a spring 236 disposed in the shaft 234 between the member 232 and the blind end of the bore 234 within the shaft 202. The portion of the member 232 extending outwardly from the bore 234 in the shaft 202 contacts the projection 152 of the plunger 134. As the plunger 134 is moved towards the end cap 254 as a result of the operation of the tool 100 and the torque limiting mechanism 132, the plunger 134 urges or presses the engagement member 232 into the bore 234 against the bias of the spring 236. When the plunger 134 has moved the member 232 into the bore 234 a specified amount, at which point the spring 236 can no longer be compressed, which corresponds to a particular torque level slightly less than the maximum torque level at which the tool 100 can be utilized without activation of the torque limiting mechanism 132. At this point, any further movement of the plunger 134 against engagement member 232 the causes the shaft 202 to move axially along the channel 121 towards the end cap 254. This movement of the shaft 202 is against the bias of the locking mechanism 212, which, upon continued escalation of the torque applied by the tool 100, eventually causes the bearing 216 to move into the shaft 218 against the bias of the spring 220, thereby disengaging the mechanism 212 from the shaft 202, and allowing the biasing member 224 to move the outer end 206 of the shaft 202 outwardly through the aperture 208 in the end cap 254. This provides a visual indication of the torque level at which the tool 100 is operating prior to the slippage of the torque limiting mechanism 132 in the manner described previously.

In addition, after the outer end 206 of the shaft 202 has been urged out of the aperture 208 by the member 224 when the specified torque level is reached, the indicator mechanism 200 can be reset by urging the shaft 202 into the handle 102 such that the bearing 216 is re-engaged with the groove 222 on the shaft 202.

Figure 6:
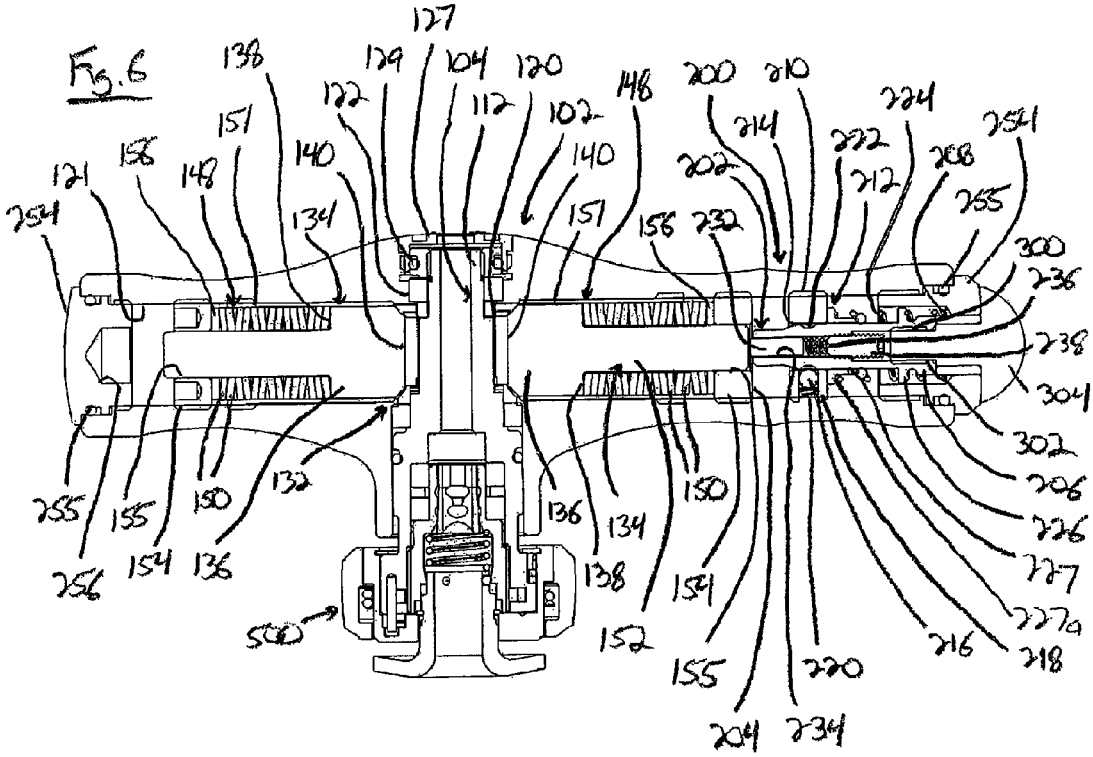
FIG. 6 is a cross-sectional side plan view of the tool of FIG. 5.
Figure 7:
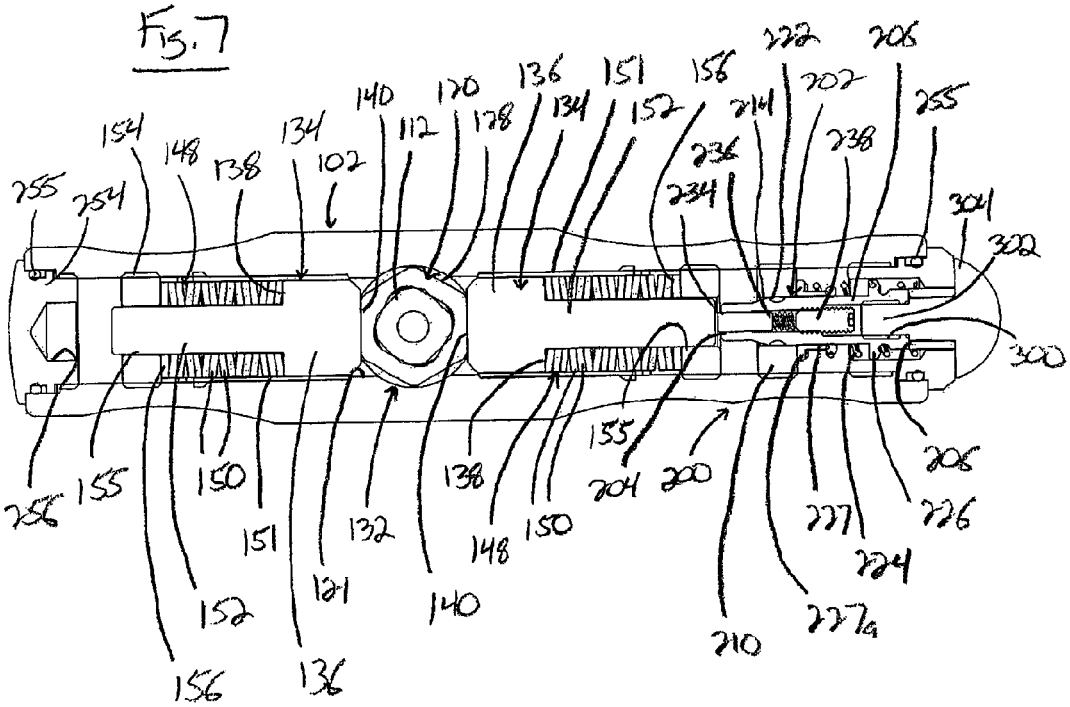
FIG. 7 is a cross-sectional top plan view of the tool of FIG. 5.

The amount of force that is necessary to disengage the shaft 202 from the locking mechanism 212 can be selected to be equal to or preferably slightly less than the amount of torque necessary to cause the mechanism 132 to operate, thereby providing an indication of when the tool is approaching the maximum torque limit but prior to the operation of the mechanism 132. Alternatively, the force required to disengage the locking mechanism 212 can be selected to be significantly less than that required to operate the mechanism 132, such as any fraction of the maximum torque limit required to operate the mechanism 132. In either case, as best shown in FIGS. 5-7, the mechanism 200 includes an adjustment screw 238 threadedly engaged within the bore 234 in the shaft 202 opposite the engagement member 232. The screw 238 can be adjusted in position with regard to the shaft 202 by rotating the further into the bore 234 or by moving the screw 238 further out of the bore 234 as desired. The positioning of the screw 238 within the bore 234 determines the compression of the spring 236 disposed between the engagement member 232 and the screw 238, and therefore determines the amount of force required to fully compress the spring 236 and consequently move the shaft 202 with regard to the locking mechanism 212, to activate the indicator mechanism 200. Further, while the screw 238 is the preferred embodiment, other suitable adjustment members may be substituted for the screw 238, such as an expandable pin or other mechanical member.

In alternative embodiments, the indicator mechanism 200 can include multiple locking mechanisms 212 or other suitable devices that become disengaged at different torque levels to provide multiple indications of the particular torque level using the shaft 202. Additionally, the shaft 202 can be formed with multiple grooves 222 spaced axially along the shaft 202, with each groove 222 corresponding to a particular torque value being exerted by the tool 100. Further, the shaft 202 may includes various indicia or gradations 600 on the outer end 208 corresponding to the specified torque levels, such that the amount of torque currently applied to the tool 100 by the individual will be displayed on the exposed outer end 208 of the shaft 202. The indicia can also be disposed on the shaft 202 in a manner that enables the indicia 600 to be selectively viewed through a window (not shown) in the handle 102. For example, red and green indicia can be located on the side of the shaft 202, such that when the torque level is below a pre-set limit, the green section shows through the window, while when the torque level is above the limit, the shaft 202 has moved to display the red section through the window.

Additionally, instead of the shaft 202 protruding outwardly from the handle 102 functioning as the primary indication means, the mechanisms 200 can use any other suitable mechanism, such as an audible indicator, a light, a vibration mechanism, or any other suitable mechanical or electrical mechanism. The mechanism can be activated by the movement of the shaft 202, or by any other suitable means.

Also, because the biasing or compression members 148 can be selected to have a variable spring rate, the indicator mechanism 200 can be designed to provide a real-time indication of the amount of torque being exerted by the tool 100. In this construction, the shaft 202 of the indicator mechanism 200 is not secured by a locking mechanism 212, and can be continuously urged outwardly from the handle 102 in response to the changing spring rate of the compression members 148 as increased torque is applied by the tool 100. Where the shaft 202 includes the gradations thereon, the continuous movement of the shaft 202 enables the shaft 202 to continuously indicate the amount of torque applied by the tool 100, rather than only at specific pre-set values. When the tool 100 is not in use, a suitable mechanism, such as the biasing member 224, retracts the shaft 202 within the handle 102.

Further, the mechanism 20 can be utilized with tools 100 that do not include a torque limiting mechanism 132, such that the mechanism is directly engaged with the shaft 104 in a manner that transmits the torque being applied by the tool 100 to the mechanism 200 in a manner that operates the mechanism 200 to indicate the amount of torque being applied by the tool 100.

Various other embodiments of the present invention are contemplated as being within the scope of the filed claims particularly pointing out and distinctly claiming the subject matter regarded as the invention.

The invention claimed is:

1. A torque wrench comprising:

a) a handle;

b) a drive shaft disposed within and extending outwardly from the handle;

c) a torque limiting mechanism disposed within the handle and having a plunger operably engaged with the drive shaft to limit the maximum torque that can be transferred from the handle to the shaft; and d) an indicator mechanism disposed within the handle and operably connected to the plunger of the torque limiting mechanism to move with the plunger when a specified torque level is reached, the indicator mechanism operable to provide a visual indication when the torque applied by the wrench reaches the specified level below the level at which the torque limiting mechanism operates.

2. The wrench of claim 1 further comprising a ratcheting mechanism engaged with the drive shaft.

3. A torque wrench comprising:

a) a handle;

b) a drive shaft disposed within and extending outwardly from the handle;

c) a torque limiting mechanism disposed within the handle and having a lunger operably engaged with the drive shaft to limit the maximum torque that can be transferred from the handle to the shaft; and d) an indicator mechanism disposed within the handle and operably connected to the plunger of the torque limiting mechanism, the indicator mechanism operable to provide a visual indication when the torque applied by the wrench reaches a specified level below the level at which the torque limiting mechanism operates, wherein the indicator mechanism further comprises:

a) an indicator shaft slidably positioned within the handle and connected to the plunger of the torque limiting mechanism; and b) a locking mechanism disposed within the handle and selectively engageable with the indicator.

4. The wrench of claim 3 wherein the locking mechanism is biased into engagement with the indicator shaft.

5. The wrench of claim 4 wherein the bias of the locking mechanism is adjustable.

6. A method for engaging a fastener with a substrate; the method comprising the steps of:

a) providing a torque wrench including a handle, a drive shaft disposed within and extending outwardly from the handle, a torque limiting mechanism disposed within the handle and having a plunger operably engaged with the drive shaft to limit the maximum torque that can be transferred from the handle to the shaft, and an indicator mechanism disposed within the handle and operably connected to the plunger of the torque limiting mechanism to move with the plunger when a specified torque level is reached, the indicator mechanism operable to provide a visual indication when the torque applied by the wrench reaches the specified level below the level at which the torque limiting mechanism operates;

b) engaging the drive shaft with the fastener; and c) rotating the fastener with the wrench until the indicator mechanism provides an indication of the application of the specified torque level.

7. A method of providing an indication of torque applied by a device, the method comprising the steps of:

a) providing an indicator connected to a rotatable shaft of the device, the indicator being slidably movable with regard to the shaft, and a locking mechanism engaged with the indicator, wherein the locking mechanism is disengageable from the indicator when the device is used to apply a specified amount of torque to an item;

b) applying torque to the item utilizing the device until the indicator provides an indication that the specified amount of torque is applied by the device.

* * * * *